US012601075B2

(12) United States Patent
Wilson et al.

(10) Patent No.: US 12,601,075 B2
(45) Date of Patent: Apr. 14, 2026

(54) APPARATUS AND METHOD FOR ELECTROLYTE SOLUTION PRODUCTION

(71) Applicant: Air Products and Chemicals, Inc., Allentown, PA (US)

(72) Inventors: Graeme Richard Wilson, Surrey (GB); Timothy Edward Conway, Allentown, PA (US); Barry W. Diamond, Carmel, IN (US); Matthew William Akhurst, Rotterdam (NL); Senthilkumar Nanjappan, Oprington (GB)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 695 days.

(21) Appl. No.: 17/977,085

(22) Filed: Oct. 31, 2022

(65) Prior Publication Data

US 2024/0141524 A1 May 2, 2024

(51) Int. Cl.

| | |
|---|---|
| ***C25B 15/08*** | (2006.01) |
| ***C25B 1/04*** | (2021.01) |
| ***C25B 9/67*** | (2021.01) |

(52) U.S. Cl.

CPC ..... *C25B 15/08* (2013.01); *C25B 1/04* (2013.01); *C25B 9/67* (2021.01)

(58) Field of Classification Search

CPC ... B01F 33/502; B01F 35/71731; C25B 15/08
See application file for complete search history.

(56) References Cited

U.S. PATENT DOCUMENTS 6,076,702 A 6/2000 Hoffmann et al.
6,176,278 B1 1/2001 Gill et al.
(Continued)

FOREIGN PATENT DOCUMENTS

EP 3188296 A1 * 7/2017 ..... H01M 8/0656
EP 3188296 B1 2/2020
(Continued)

OTHER PUBLICATIONS

Google Patents translation of Mitsune (JP2004146120A), published May 4, 2004 (Year: 2004).*
(Continued)

*Primary Examiner* — Elizabeth Insler
(74) *Attorney, Agent, or Firm* — Matthew R. Weaver

(57) ABSTRACT

A process and apparatus for electrolyte solution production can be provided so that a modular production can be provided. The modular electrolyte production can be provided so that the production system is mobile for being used in multiple different plants at different geographical locations that are remote from each other. Embodiments can be configured so that electrolyte production is made for a plant specific application that provides an electrolyte solution having a pre-selected concentration of at least one electrolyte for use in at least one electrolyzer of the plant. The production can be mobile so it can be provided at different sites to make the same type of solutions or different solutions specific to the needs of the plants it may support. Some embodiments can utilize an electrolyte material handling device that also modular and mobile. Other embodiments can be configured to utilize an on-site electrolyte material handling device.

20 Claims, 5 Drawing Sheets

(56) References Cited

U.S. PATENT DOCUMENTS

| | | | | |
|---|---|---|---|---|
| 2003/0006248 | A1 | 1/2003 | Gill et al. | |
| 2009/0177313 | A1 * | 7/2009 | Heller | B28C 9/049 700/214 |
| 2011/0233069 | A1 | 9/2011 | Rasirc | |
| 2019/0390354 | A1 | 12/2019 | Frimann | |

FOREIGN PATENT DOCUMENTS

| | | | | |
|---|---|---|---|---|
| IN | 2020213638 | A | | 7/2021 |
| JP | 2004146120 | A | * | 5/2004 |

OTHER PUBLICATIONS

Flexicon Discharger Ad, flexicon.com, Flexicon Corportaion 2020
1 pg.

* cited by examiner

APPARATUS AND METHOD FOR ELECTROLYTE SOLUTION PRODUCTION

FIELD

The present innovation relates to apparatuses and methods for forming electrolyte solution for use in electrolysis systems. Embodiments can include, for example, plants, mobile electrolyte solution production systems, electrolyte solution production systems, and methods of making and using the same.

BACKGROUND

Green chemicals productions facilities can utilize electrolyzers for the production of hydrogen from water. The formed hydrogen may then be used in a chemical production or in another plant process or operation. The electrolyzers can utilize an electrolyte solution to facilitate the formation of hydrogen from water. Examples of electrolyte solutions that can be used in connection with electrolyzers can be appreciated from European Patent Publication No. EP 3 188 296 A and Indian Patent Application Publication No. 202021003638 A.

The electrolyte solution utilized in electrolyzers can often be provided by ship, rail or truck to an operator of an electrolyzer. However, the shipping costs for the solution can be high. Also, storage and transportation can be complicated as the electrolyte solution can often be corrosive, which can create maintenance and operational issues (e.g. leaks due to corrosion of piping, storage vessel, etc. used in transportation or on-site storage). Corrosion byproducts that are formed can also contaminate the electrolyte solution. To account for such issues, time consuming maintenance procedures and significant infrastructure may be needed to account for the corrosiveness of the solutions and safety issues associated with the handling of the corrosive material. These types of challenges can make the transport and storage of such materials difficult and expensive.

SUMMARY

We have determined that the conventional process of acquisition and use of electrolyte solutions can pose significant issues in terms of cost and operational inefficiencies. These issues can be particularly significant for large plant operations that may require significantly large quantities of an electrolyte solution (e.g. a quantity of over 5,000 $m^3$ of KOH or NaOH). This type of quantity can be hard to deliver by ship, truck, or other type of freight. For example, transportation of this type of quantity of electrolyte solution can require offloading from a ship via a jetty to a storage tank in a situation where either the jetty has to exist at the usage facility or the storage tank would have to be at a local port where further transportation via multiple tanker trucks could then result in delivery to a final destination. These types of delivery options involve a substantial investment in equipment. They also can involve complex logistics.

Moreover, the corrosive nature of the solution material can pose significant storage problems even after the material is delivered to a site operator due to the corrosiveness of the material and the potentially long period of time that the material may need to be stored prior to its use. These types of issues can lead to substantial capital costs associated with storage and transportation vessels and vehicles as well as substantial operational costs associated with the storage and use of the corrosive solution material and maintenance of the storage devices that may be required to facilitate use of the material on site.

We have developed embodiments of plants, mobile electrolyte solution production systems, electrolyte solution production systems, processes for electrolyte solution production, and methods of making and using the same that can help avoid storage and transportation issues associated with electrolyte solution acquisition and use. Moreover, embodiments can be provided in a mobile, modular configuration so that an electrolyte production system can be utilized on site when needed while also being available for use at various other sites as well. Embodiments can also be configured so an electrolyte solution production system can be used on-site at one location to make electrolyte solution for that location needed for operations for a first period of time. After a desired quantity is provided at the first site, the system can then be transported to one or more other sites for use at one or more other facilities so that the same production system can be used at numerous different sites. The system can provide the same electrolyte solution at those sites or provide a different type of electrolyte solution (e.g. same solution having a different electrolyte concentration or a different electrolyte solution using one or more different electrolytes, etc.) Embodiments can provide a flexible, modular operational configuration that can permit different electrolyte solutions to be formed at different sites in different quantities or production rates to meet site operational needs for various different plants or manufacturing facilities. The option of sharing of the mobile, modular electrolyte solution production system among multiple sites can permit the cost associated with operation, maintenance and transport of the system to be shared among numerous plant operators while also providing improvements in safety, maintenance, and operational performance.

In some embodiments, an electrolyte solution production system can be configured to form an electrolyte solution having a pre-selected concentration of at least one electrolyte. The solution can also include a solvent. The solvent can be water or include water (e.g. be demineralized water, deionized water, potable water, etc.). The solution can be a liquid solution that includes at least one electrolyte mixed therein to form an aqueous electrolyte solution, for example. The electrolyte can be potassium hydroxide (KOH) and/or sodium hydroxide (NaOH), for example. The electrolyte can also, or alternatively include sodium chloride (NaCl) or potassium chloride (KCl). The pre-selected concentration can be between 0.5 weight percent ("wt %") and 50 wt %, between 1 wt % and 50 wt %, between 1 wt % and 30 wt %, or between 1 wt % and 40 wt % in some embodiments. The pre-selected concentration can be defined to meet any type of pre-selected concentration requirement in addition, or as an alternative, to these exemplary concentration ranges. The electrolyte solution can be formed by use of a solid particulate material being added to a tank with a liquid solvent (e.g. water) for mixing therein at a pre-selected temperature within a pre-selected temperature range for a pre-selected residence time (or pre-selected mixing time). In some implementations, the mixing can be performed so that the solid particulate material is added to the tank after the tank is filled with a liquid solvent.

The pre-selected temperature range can be, for example, between 40° C. and 60° C., or between 45° C. and 55° C. A pre-selected temperature can be a temperature of 45° C. or 50° C. in some embodiments. Other suitable temperatures and temperature ranges can also be utilized. For example, the temperature can be controlled so that the pre-selected temperature or temperature range is sufficient to keep the electrolyte cool enough during mixing to prevent exceeding a design temperature of the mixing tank (e.g. a design temperature of a plastic tank having an agitator positioned therein, etc.).

The electrolyte solution can also, or alternatively, be formed by mixing a relatively small volume of a highly concentrated electrolyte solution in a tank with water and/or other material for mixing therein for a pre-selected residence time or pre-selected mixing time at a pre-selected temperature within a pre-selected temperature range and a pre-selected pressure within a pre-selected pressure range. For embodiments that may utilize a highly concentrated electrolyte solution as the electrolyte material, such a solution can be at least 25 wt % of an electrolyte (e.g. KOH or NaOH), at least 30 wt % of an electrolyte, at least 50 wt % of an electrolyte or higher than 50 wt % electrolyte (e.g. between 50 wt % and 75 wt % electrolyte, between 50 wt % and 85 wt % electrolyte, etc.). The dilution of the highly concentrated electrolyte solution can be performed to provide an electrolyte solution having the pre-selected electrolyte concentration in a mixing tank (e.g. a 30 wt % electrolyte solution can be diluted to form an electrolyte solution of 0.5 wt % electrolyte, etc.).

In some implementations, the utilization of a highly concentrated electrolyte solution can be performed after an initial formation of an electrolyte solution is provided by adding solid particulate electrolyte material to a mixing tank for diffusion therein via a liquid solvent (e.g. water, demineralized water, other suitable liquid solvent, etc.) to further increase the content of electrolyte within the formed solution to being at a pre-selected electrolyte concentration. In other implementations, the electrolyte solution may be formed via the dilution of the electrolyte solution in a mixing tank with a liquid solvent in the tank (e.g. mixing demineralized water with the highly concentrated electrolyte solution in a tank) and agitation of the mixture of the solvent and highly concentrated electrolyte solution within the tank.

In some embodiments, the electrolyte solution production system can include an electrolyte solution mixing device. The mixing device can be arranged to receive electrolyte material (e.g. solid particulates of an electrolyte material, a highly concentrated electrolyte solution etc.) for feeding into a mixing tank. The mixing tank can be temperature controlled and also include an agitation system to facilitate mixing of the electrolyte material within water to form the electrolyte solution. The electrolyte solution production system can be a modular design that is supported on a single skid or base that can facilitate transport of the system to different sites. Various conduits of the electrolyte solution mixing device can be connectable and decouplable from a conduit arrangement of plant. For example, one or more conduits can be disconnected from an intermediate storage and transport system of a plant or other plant system to facilitate removal and transport of the mixing device and while also permitting the device to be connected into a plant for connection and use of the system. Such connections can be provided by valves, mechanically attached fittings, or other types of connection mechanisms. In some embodiments, a single base (e.g. single skid, etc.) can be configured to support the tank and other elements of the electrolyte solution mixing device to permit a lift to easily unload the electrolyte solution mixing device from a trailer or container to locate it at a suitable site for connection to a plant. Once positioned, various conduits of the electrolyte solution mixing device can be connected to the plant (e.g. purge conduit (s), a solvent feed conduit, heat exchanger cooling medium conduits, and an electrolyte solution output conduit) for operation of the electrolyte solution mixing device to form electrolyte solution and feed it toward at least one electrolyzer of the plant. Once the solution has been sufficiently supplied, the electrolyte solution mixing device can be decoupled from the plant and the single base (e.g. single skid, etc.) can be moved onto a trailer or container for transport to a new site via a transport vehicle (e.g. truck, railcar, etc.).

Embodiments of the electrolyte solution production system can be configured to utilize an on-site material handling device that can be configured to move a vessel storing the electrolyte material (e.g. solid particulates within a bag, highly concentrated solution within a storage vessel, etc.) to a feed device of the electrolyte solution mixing device. Such an on-site system can include an on-site crane, an on-site hoist mechanism, an on-site bag lifting device, an on-site electrolyte material vessel lifting mechanism, or an on-site structure that can permit one or more operators to lift and feed the electrolyte material into the feed device of the electrolyte solution mixing device or into the tank of the electrolyte solution mixing device Other embodiments of the electrolyte solution production system can include a mobile, modular material handling device. Examples of such a mobile material handling device can include a hoist system or other type of electrolyte material vessel lifting mechanism that is supported on a skid or other base for ease of transport and delivery to different sites for positioning near the feed device of the electrolyte solution mixing device so a hoist or other lifting mechanism of the material handling device can lift a vessel of electrolyte material to a feed device of the electrolyte solution mixing device or over a tank of the electrolyte solution mixing device for feeding the material into the tank. In some configurations, the base or skid of the electrolyte solution mixing device can also support the hoist or other electrolyte material handling lift mechanism so both the electrolyte solution mixing device and the material handling device can be moved and transported at the same time via the same base or skid. In other implementations, the material handling device can be on a base or skid that is separate and different from the base or skid of the electrolyte solution mixing device.

In a first aspect, an apparatus for electrolyte solution production can include a mobile electrolyte solution mixing device. The mobile electrolyte solution mixing device can include a base sized and configured for transportation via a transport vehicle and a tank supported on the base. The tank can have a mixing chamber (e.g. a mixing chamber can be defined in the tank, the mixing chamber can be defined within the tank by at least a bottom and one or more sidewalls attached to the bottom, the mixing chamber can be defined in the tank by a bottom of the tank, a top of the tank, and one or more sidewalls attached between the top and bottom, etc.). The tank can be configured to receive electrolyte material in the mixing chamber and a liquid solvent in the mixing chamber to form an electrolyte solution therein. The mobile electrolyte solution mixing device can also include an intermediate storage and transport feed conduit connected to the tank to feed the electrolyte solution from the mixing chamber to an intermediate storage and transport system of a plant.

The intermediate storage and transport feed conduit can be configured to be releasably connectable to an intermediate storage and transport system of a plant so that the mobile electrolyte solution mixing device can be connected to the intermediate storage and transport system of a first plant to provide electrolyte solution for one or more electrolyzers of the first plant. Once that first plant has a sufficient supply of electrolyte solution, the mobile intermediate storage and transport feed conduit can be disconnected or decoupled from the intermediate storage and transport system of the first plant so that the mobile electrolyte solution mixing device can be moved to a new site of a second plant to supply electrolyte solution to that second plant. Once moved to the new site of the second plant, the intermediate storage and transport feed conduit can be connected to the intermediate storage and transport system of the second plant for supplying of electrolyte solution to one or more electrolyzers of the second plant. The decoupling and coupling of the mobile electrolyte solution mixing device can also include coupling and decoupling of other conduits (e.g. a liquid solvent feed conduit, one or more purge conduits, one or more heat exchanger cooling medium feed conduits, one or more heat exchanger warmed cooling medium output conduits, etc.) as well as other elements that can also be supported on the base of the mobile electrolyte solution mixing device.

Transport of the mobile electrolyte solution mixing device can be facilitated by the base. In some exemplary embodiments, the base can be structured as a skid or other type of base that can directly contact the ground, floor, truck bed, or other surface so that the base can be lifted and moved to move the mobile electrolyte solution mixing device to different locations. The base can support the tank as well as other elements of the mobile electrolyte solution mixing device (e.g. a pump, a heat exchanger, conduits, an agitator, a feed device, a filtering device, etc.) that can be included in the mobile electrolyte solution mixing device so that a lift or other device that may move the base to a transport vehicle can also simultaneously move those other elements supported on the base. Such a configuration can permit the mobile electrolyte solution mixing device to be loaded and unloaded from a transport vehicle efficiently and also permit the device to be moved more quickly and efficiently via a transport vehicle (e.g. truck having a flatbed or container or other type of trailer for moving the mobile electrolyte solution mixing device).

In a second aspect, the mobile electrolyte solution mixing device can also include a feed device positioned to feed the electrolyte material into the mixing chamber. In some embodiments, the feed device can include a hopper configured to store electrolyte material within a cavity or chamber of the hopper as well as a vessel feed valve and a tank feed valve that are connected to the hopper. The hopper can be positionable over the tank to facilitate feeding of electrolyte material into the mixing chamber of the tank. In some configurations, the feed device can be mounted to a top of the tank and/or connected to a sidewall of a tank to position the hopper over the tank or on top of the tank.

In a third aspect, the liquid solvent can be any type of liquid solvent suitable to form a desired electrolyte solution. In some embodiments, the liquid solvent can include water. The liquid water can be potable water, deionized water or demineralized water, for example.

In a fourth aspect, the electrolyte material can include a material having at least one pre-selected electrolyte or a combination of multiple electrolytes. In some embodiments, the electrolyte material is a solid particulate material that includes KOH, NaOH, KCl, NaCl, and/or combinations thereof. Other electrolytes can also be included or utilized in other embodiments. The electrolyte material can include, for example, solid pellets of electrolyte material, flakes of electrolyte material, combinations thereof, or a highly concentrated electrolyte solution that is to be mixed in the mixing chamber to dilute the solution so the formed electrolyte solution has a pre-selected electrolyte concentration that is less than the concentration of the electrolyte within the highly concentrated electrolyte solution.

In some embodiments, the electrolyte solution can comprise water and an electrolyte. The electrolyte can be KOH, NaOH, NaCl, or KCl and the electrolyte solution can have a pre-selected concentration of the electrolyte within a range of between 0.5 weight percent (wt %) and 40 wt %, between 0.25 wt % to 30 wt %, between 0.0.25 wt % and 10 wt %, or between 0.5 wt % to 10 wt %.

In a fifth aspect, embodiments of the apparatus can also include a material handling device. The material handling device can be supported on the base of the mobile electrolyte solution mixing device or be supportable on a separate base. The material handling device can include a lifting mechanism to lift at least one vessel retaining the electrolyte material feed feeding the electrolyte material to the mixing chamber of the tank or a feed device connected to the tank to receive the electrolyte material from the at least one vessel for feeding the electrolyte material into the mixing chamber.

In a sixth aspect, the material handling device can include an elongated member that is retractable and extendable and a vessel holding device connected to the elongated member. In some implementations, the elongated member can include a chain, cord, rope, or cable that can be wound on or unwound from a spool or pulley. The vessel holding device can include a jaw, hook, or other device configured to hold and/or lift a vessel for movement of the vessel for feeding electrolyte material within the vessel into a feed device and/or tank of the mobile electrolyte solution mixing device.

In a seventh aspect, the material handling device can be configured as a hoist or a crane.

In an eight aspect, the material handling device can be supported on the base of the mobile electrolyte solution mixing device or can be positionable adjacent to the tank. In some implementations, the material handling device can be located at a plant and be positioned in the plant. In some embodiments, for example, a hoist or crane can be attached to or supported by structure of the plant in which it is located.

In a ninth aspect, the mobile electrolyte solution mixing device can also include one or more of (i) a solvent feed conduit connected to the tank for feeding a liquid solvent into the mixing chamber, (ii) a pump supported by the base where the pump is connected to the tank to output the electrolyte solution out of the tank, (iii) a heat exchanger supported on the base where the heat exchanger is connected to the tank for cooling the mixing chamber, and/or (iv) an agitator positioned in the mixing chamber where the agitator can have a shaft connected to a motor to drive rotation of the shaft to spin at least one blade of the agitator within the mixing chamber. Some embodiments can include all of these elements as well as additional elements (e.g. conduit arrangements, a filtering device, purge gas conduits, etc.) or at least one of these elements, for example.

In a tenth aspect, the apparatus can include a material handling device that includes a lifting mechanism to lift at least one vessel retaining the electrolyte material for feeding the electrolyte material to the mixing chamber of the tank or a feed device connected to the tank to receive the electrolyte material from the at least one vessel for feeding the electrolyte material into the mixing chamber. The apparatus can also include the intermediate storage and transport system of the plant and at least one electrolyzer connected to the intermediate storage and transport system so that the electrolyte solution output from the tank is feedable to the at least one electrolyzer.

In an eleventh aspect, the first aspect of the apparatus can include any or all of the second aspect, third aspect, fourth aspect, fifth aspect, sixth aspect, seventh aspect, eighth aspect, ninth aspect, and/or tenth aspect (and any combination of those aspects). Embodiments of the first aspect can also (or alternatively) include other features. For example, some embodiments can include other features discussed herein in addition to one or more of these other aspects.

In a twelfth aspect, a process for electrolyte solution production can be provided. Embodiments of this aspect can be performed using an embodiment of the apparatus (e.g. an embodiment of an apparatus discussed above or an embodiment of the apparatus discussed below). Embodiments of the process can include mixing an electrolyte material fed to a mixing chamber of a tank of a mobile electrolyte solution mixing device with a liquid solvent fed to the mixing chamber to form an electrolyte solution. The tank can be supported on a mobile base of the mobile electrolyte solution mixing device. The electrolyte solution can have a concentration of an electrolyte that is within a pre-selected electrolyte concentration range. The pre-selected electrolyte concentration range can be range of between 0.5 weight percent (wt %) and 40 wt %, a range of between 1 wt % and 10 wt %, or a range of between 1 wt % and 30 wt %. After the electrolyte solution is formed, the electrolyte solution can be output from the mixing chamber to an intermediate storage and transport system for feeding the electrolyte solution to at least one electrolyzer. The process can also include decoupling the mobile electrolyte solution mixing device from the intermediate storage and transport system for transportation of the mobile electrolyte solution mixing device and moving the mobile electrolyte solution mixing device to a new site for connection to an intermediate storage and transport system at the new site for providing electrolyte solution to the new site.

In a thirteenth aspect, the process for electrolyte solution production can also include cooling material within the mixing chamber via a heat exchanger supported on the base of the mobile electrolyte solution mixing device while the mixing of the electrolyte material and the liquid solvent occurs. The cooling medium used by the heat exchanger can include, for example, cooling water, a refrigerant, or other type of cooling medium.

In a fourteenth aspect, the process for electrolyte solution production can be implemented so that the outputting the electrolyte solution is driven via at least one pump supported on the base of the mobile electrolyte solution mixing device.

In a fifteenth aspect, the process for electrolyte solution production can be implemented so that the moving of the mobile electrolyte solution mixing device to the new site includes moving the base of the mobile electrolyte solution mixing device to the new site via a transport vehicle. The transport vehicle can be a truck having a trailer (e.g. a flatbed trailer, a container trailer, etc.) that can retain the base of the mobile electrolyte solution mixing device for transport via roadways, for example. In other implementations, the transport vehicle can include a train or train car or other type of transport vehicle. The base of the mobile electrolyte solution mixing device can be sized and configured for transportation via the transport vehicle to facilitate loading onto the vehicle for transport and unloading from the vehicle for use at a site.

In a sixteenth aspect, the process for electrolyte solution production can be implemented so that the tank, a heat exchanger positioned to cool material within the mixing chamber, and a pump positioned to drive an output of the electrolyte solution out of the mixing chamber are supported on the base and are moved simultaneously with the base when the base is moved. Other elements of the mobile electrolyte solution mixing device can also be supported on its base for simultaneous movement with the base to facilitate transport of the mobile electrolyte solution mixing device to a new site.

In a seventeenth aspect, the process for electrolyte solution production can include lifting at least one vessel having the electrolyte material stored therein to a feed device connected to the tank or over the tank to feed the electrolyte material to the mixing chamber. The lifting can be provided by a hoist, a crane, or other type of lifting system or material handling device.

In an eighteenth aspect, the twelfth aspect can include any or all of the thirteenth, fourteenth, fifteenth, sixteenth, and seventeenth aspects as well as other features or process steps discussed herein. For example, embodiments of the process or apparatus for electrolyte solution production can include a control panel that has a controller configured to help control and/or monitor operations and/or implementation of the process. For instance, the controller can be connected to valves, sensors, level controllers, and/or detectors to implement an automated process control for electrolyte production.

Other details, objects, and advantages of our plants, mobile electrolyte solution production systems, electrolyte solution production systems, processes for electrolyte solution production, and methods of making and using the same will become apparent as the following description of certain exemplary embodiments thereof proceeds.

BRIEF DESCRIPTION OF THE DRAWINGS

Exemplary embodiments of plants, mobile electrolyte solution production systems, electrolyte solution production systems, processes for electrolyte solution production, and methods of making and using the same are shown in the drawings included herewith. It should be understood that like reference characters used in the drawings may identify like components.

FIG. 2 also illustrates schematically a first exemplary embodiment of a process for feeding electrolyte solution material to an electrolyte solution mixing device 5 of the electrolyte solution production system.

DETAILED DESCRIPTION OF EXEMPLARY EMBODIMENTS

Figure 1:
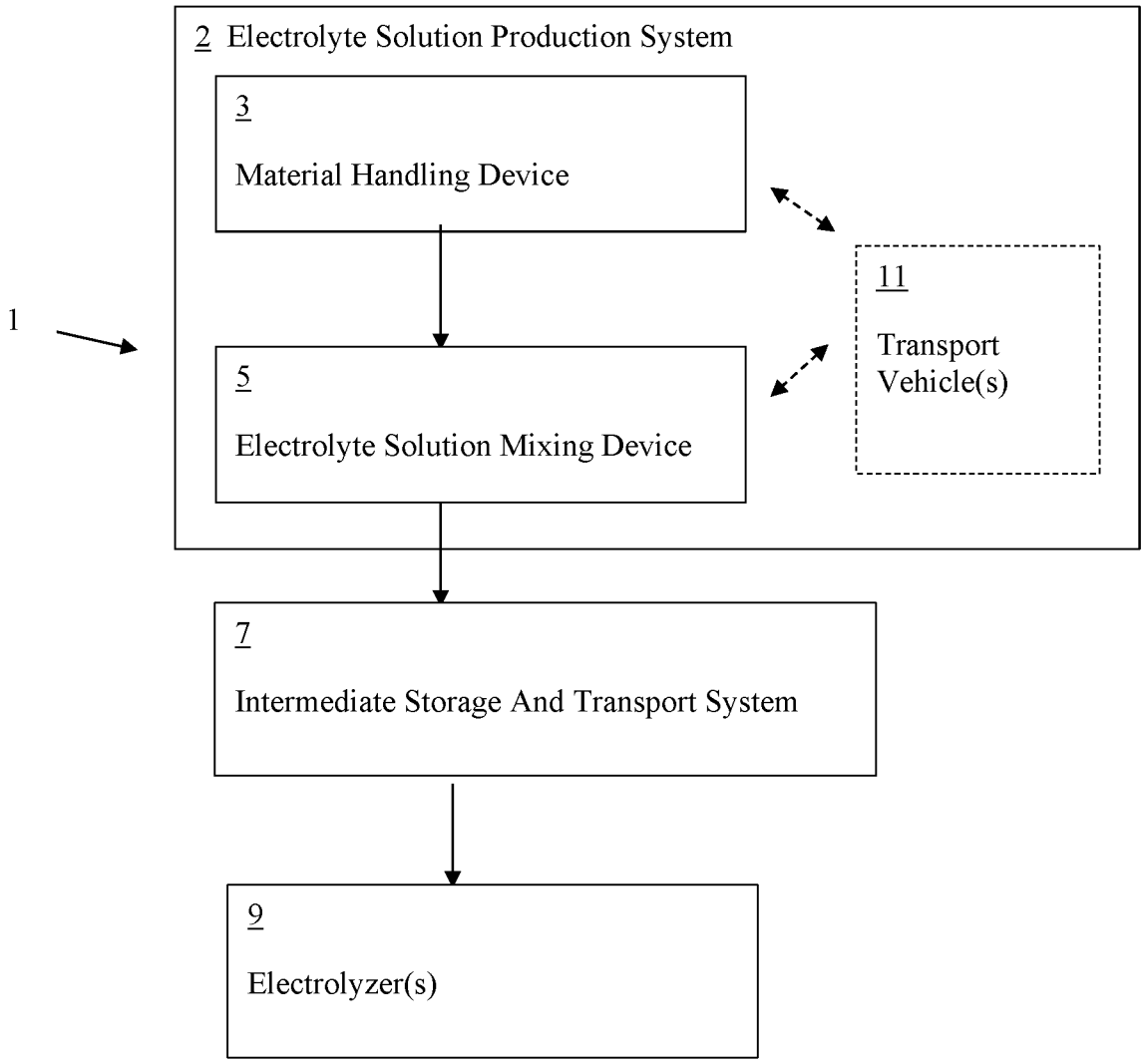
FIG. 1 is a schematic block diagram of a first exemplary embodiment of a plant 1 that includes a first exemplary embodiment of the electrolyte solution production system 2.

Referring to FIGS. 1-5, a plant 1 can include an electrolyte solution production system 2, which can include an electrolyte solution mixing device 5. The electrolyte solution production system 2 can also include a material handling device 3. The electrolyte solution mixing device 5 can be a mobile, modular unit that can be transportable via a transport vehicle 11 (e.g. flatbed of a truck, etc.). The material handling device 3 can be a mobile, modular unit that can be transportable via a transport vehicle 11 (e.g. flatbed of a truck, etc.) or can be an on-site device (e.g. an on-site hoist or lift, an on-site crane, etc.).

The electrolyte material handling device 3 can be configured to lift or otherwise transport electrolyte material to the electrolyte solution mixing device 5. The electrolyte material fed to the electrolyte solution mixing device 5 can be mixed with a liquid solvent (e.g. water, demineralized water, etc.) at a temperature within a pre-selected temperature range and pressure within a pre-selected pressure range for a pre-selected residence time or pre-selected mixing time. The electrolyte solution mixing device 5 can also include at least one agitation mechanism for agitating the liquid and electrolyte material therein for an entirety of the mixing time or residence time or at least a portion of that time.

Once the electrolyte solution is sufficiently formed and mixed to include at least one pre-selected electrolyte at a pre-selected electrolyte concentration, the electrolyte solution mixing device 5 can feed the electrolyte solution to an intermediate storage and transport system 7 of the plant 1. The intermediate storage and transport system 7 can include at least one vessel for intermediate storage of the solution and a conduit arrangement to facilitate the feeding of the electrolyte solution to and from electrolyzers 9 connected to the intermediate storage and transport system. The conduit arrangement can include one or more pumps, valves, and sensors positioned between one or more electrolyzers and one or more intermediate storage vessels to facilitate the feeding of the electrolyte solution to the electrolyzer(s) 9. The conduit arrangement can also be configured to facilitate the discharge of electrolyte solution from one or more of the electrolyzers 9 so that a new solution having a different electrolyte concentration or mixture can be fed to the electrolyzer(s) 9.

The one or more electrolyzers 9 can be configured to receive the electrolyte solution therein and form hydrogen from the water of that solution. The electrolyte solution retained in the electrolyzer(s) 9 can facilitate the transport of hydrogen and hydroxide ions for the formation of hydrogen as well as other components (e.g. oxygen, etc.) Each of the electrolyzer(s) 9 can include a membrane therein to facilitate the formation of hydrogen from the water of the electrolyte solution. The membrane can be positioned between a cathode and an anode of the electrolyzer. In some configurations, the cathode side of each electrolyzer can form hydrogen ($H_2$) and the anode side of the electrolyzer can form oxygen ($O_2$) from the water of the electrolyte solution. The formed hydrogen can be used in at least one process of the plant 1 or be utilized or formed as a product stream of hydrogen. The oxygen can also be used in at least one process of the plant 1, used to form a product stream of oxygen, or can be vented to the atmosphere.

The electrolyte solution production system 2 can be modular or mobile. For example, the electrolyte solution mixing device 5 can be configured to be fluidly connected to an intermediate storage and transport system 7 that also permits the electrolyte solution mixing device 5 to be decoupled from the intermediate storage and transport system 7 after a sufficient amount of electrolyte solution is produced so that the electrolyte solution mixing device 5 can be moved to a new site for use at the new site to provide electrolyte solution for the plant 1 at the new site (a site that can be remote from the initial site). For example, the connection between the electrolyte solution mixing device 5 and the intermediate storage and transport system 7 can be releasable connection or a decouplable connection so that the electrolyte solution mixing device 5 can be connected to the intermediate storage and transport system 7 to supply electrolyte solution to the intermediate storage and transport system 7 and subsequently be decoupled from the intermediate storage and transport system 7 so that the electrolyte solution mixing device can be transported to another site at a different location for connection to that site's intermediate storage and transport system 7 for use at that other site.

For embodiments that include a heat exchanger 5HX, the heat exchanger fluid (e.g. cooling medium) conduits for feeding the fluid to the heat exchanger 5HX and outputting the fluid from the heat exchanger 5HX can also be releasable connections that can permit those conduits to be connected for heat exchanger fluid being passed into and out of the heat exchanger 5HX when the electrolyte solution mixing device 5 is connected to the plant 1 for use in supplying electrolyte solution to the plant's intermediate storage and transport system 7 while also being disconnectable or decouplable from the heat exchanger fluid source to permit the electrolyte solution device 5 to be moveable and transportable after its use. Other conduits of the electrolyte solution mixing device 5 can also be decoupled from plant units at the initial site as well (e.g. purge conduits Spurge, solvent feed conduit 5*w*, etc.) to facilitate removal and transport of the electrolyte solution mixing device 5.

A transport vehicle 11 can be utilized to move the electrolyte solution mixing device 5 (e.g. via transportation on a flatbed trailer of a truck, container of a truck or railcar, or by use of another type of vehicle transportation device). A hoist, a lift, a forklift or other type of loading device or unloading device may be utilized to help load and/or unload the electrolyte solution mixing device 5 from the transport vehicle for transportation as well. In yet other contemplated options, the base of the electrolyte solution mixing device 5 can be structured as a type of trailer that can include stands or other supports to support the device on the ground or floor so it is stable when in use at a site. The stands or supports may be adjustable or removable to facilitate movement to another location (e.g. via towing by a vehicle, etc.).

Once at the new site, which can be geographically remote from the initial site, the electrolyte solution mixing device 5 can be connected to the new site's intermediate storage and transport system 7 so that a formed electrolyte solution formed via the electrolyte solution mixing device 5 can be fed to the intermediate storage and transport system 7 at the new site for use to feed one or more electrolyzers 9 at the new site that may be connected to the new site's intermediate storage and transport system 7. Other conduits can also be coupled to the electrolyte solution mixing device 5 as well (e.g. heat exchanger 5HX cooling medium conduits can be connected to a cooling medium circuit of the plant, purge conduits Spurge can be connected to at least one source of a purge fluid, solvent feed conduit 5*w* can be connected to a plant's source for solvent, etc.). The decoupling, moving, and connecting of the electrolyte solution mixing device 5 can be performed in multiple cycles so that the electrolyte solution mixing device 5 can be utilized at multiple different sites to provide electrolyte solution to those different sites.

In some situations, the material handling device 3 of the electrolyte solution production system 2 can also be modular and mobile. In such embodiments, the material handling device 3 can also be transported with the electrolyte solution mixing device 5 (e.g. via same transport vehicle 11 or use of another, second transport vehicle 11). For instance, in some embodiments, the material handling device 3 can be integrated into the transport vehicle 11 (e.g. be a hoist system supported by a flatbed of a truck, etc.) or into the electrolyte solution mixing device 5 (e.g. be supported by a base of the electrolyte solution mixing device 5). In other embodiments, the material handling device 3 can be a separate device positionable adjacent to the electrolyte solution mixing device 5. In such embodiments, a second transport vehicle 11 may be used for transport of the material handling device 3 or the material handling device 3 can be sized so it can be transported on the same flatbed trailer, transport container, or other transportation mechanism on which the electrolyte solution mixing device 5 is transportable.

In other situations, each site may have its own material handling device 3 that can be positionable adjacent to the electrolyte solution mixing device 5 for lifting and/or feeding electrolyte material into a mixing tank of the electrolyte solution mixing device 5. In such situations, the material handling device 3 may not be moved while the electrolyte solution mixing device 5 can be moved to different sites. In such embodiments, the electrolyte solution production system 2 can be a mobile system that includes a mobile and modular electrolyte solution mixing device 5.

Figure 2:
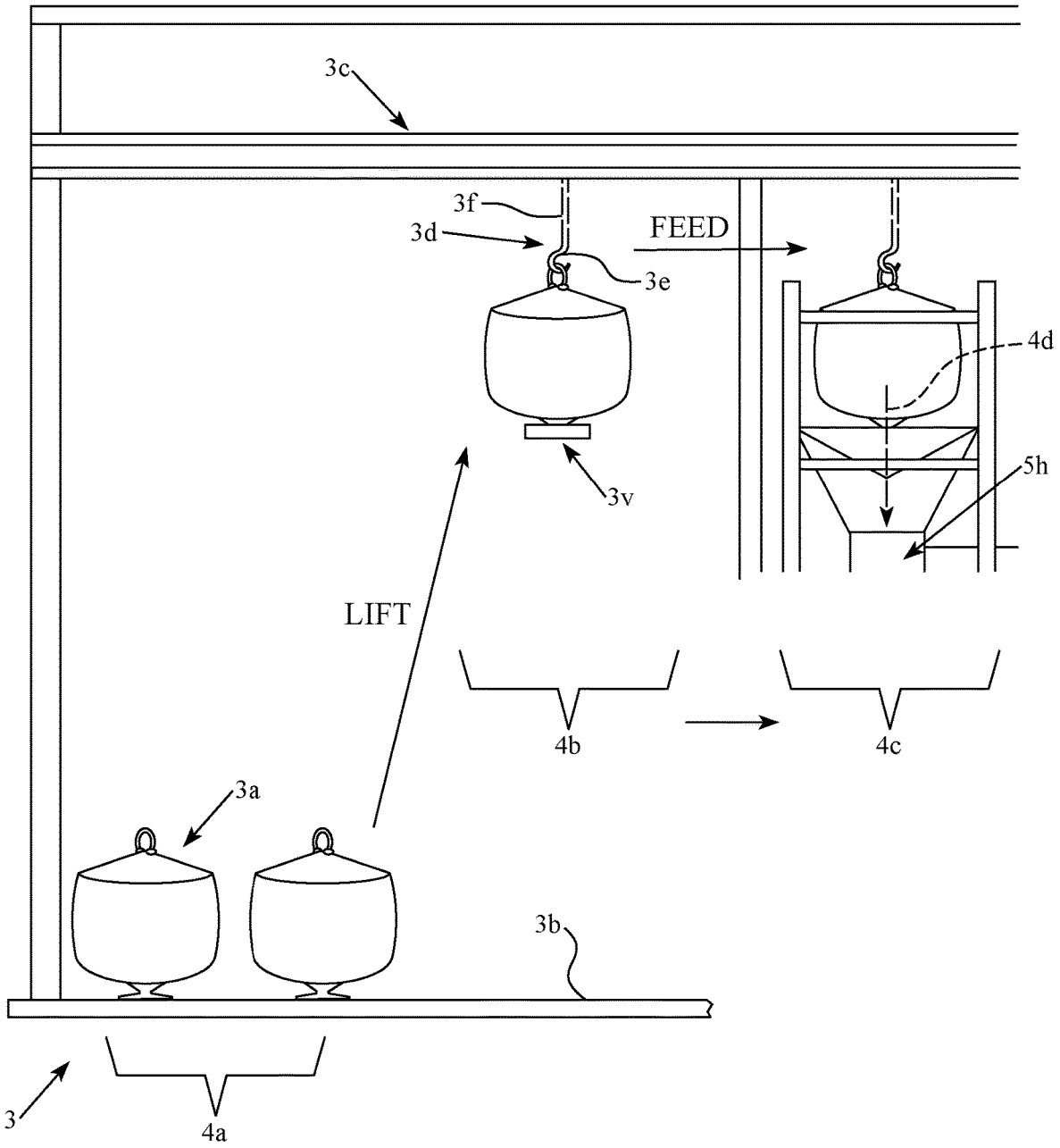
FIG. 2 is a schematic view of a first exemplary embodiment of an electrolyte material handling device 3 that can be included in the first exemplary embodiment of the electrolyte solution production system 2 and/or the first exemplary embodiment of the plant 1 shown in FIG. 1.

FIG. 2 illustrates an exemplary embodiment of a material handling device 3 that can be utilized in the electrolyte solution production system 2. The material handling device 3 can include a base 3*b* that can support one or more electrolyte material retaining vessels 3*a*. Each electrolyte material retaining vessel 3*a* can be a bag, a case, a container, a tank, or other storage vessel that can retain solid particulates of electrolyte material or a highly concentrated liquid solution having a high concentration of at least one electrolyte (e.g. at least 50 wt % KOH, at least 50 wt % NaOH, at least 50 wt % NaCl, at least 50 wt % KCl, etc.). In some configurations, each vessel 3*a* can have a valve 3*v*. The valve 3*v* can be positioned on or adjacent a bottom of the vessel or can be positioned on a lower portion of the vessel to facilitate the feeding of electrolyte material from the vessel 3*a* to a feed device 5*h* of an electrolyte solution mixing device 5. For instance, the valve 3*v* can be actuated from a closed position to an open position after being positioned over a tank and/or over or in a feed device 5*h* of the electrolyte solution mixing device 5 to feed the material to the tank of the electrolyte solution mixing device 5 or the feed device 5*h* of the electrolyte solution mixing device 5.

The material handling device 3 can also include a lifting mechanism 3*d* that can include a moveable elongated member 3*f* (e.g. a cable, wire, cord, rope, chain, a moveable boom, etc.) connected to a vessel holding device 3*e*. The moveable elongated member 3*f* can be retractable and extendable to lift and lower a vessel 3*a* as well as be movable for moving an electrolyte material retaining vessel 3*a* from a position remote to a tank of an electrolyte solution mixing device 5 to a position over the tank of the electrolyte solution mixing device 5 or to a feed device 5*h* of the electrolyte solution mixing device. For instance, the lifting mechanism 3*d* can adjust the position of the elongated member 3*f* and the vessel holding device 3*e* attached thereto to lift a vessel 3*a* into, in, or over a feed device 5*h* and/or tank 5*t* of an electrolyte solution mixing device 5.

The vessel holding device 3*e* can include at least one hook, a moveable claw configured to open to receive a vessel and close to retain the vessel, a magnetic holder, or other type of suitable holding device. The vessel holding device 3*e* can be coupled to a distal end of the moveable elongated member 3*f* or be positioned to another portion of that member.

The elongated member 3*f* can be coupled to a guide or boom for lateral motion of the elongated member 3*f* and the vessel holding device 3*e*. In some embodiments, the guide or boom can include an upper rail 3*c* or other element along which an elongated member guide or trolley can travel to help define a path of travel for at least a portion of the elongated member 3*f* or a pulley about which a portion of the elongated member engages for retraction and extension of the elongated member 3*f*. The upper rail 3*c* or other element can be positioned vertically above a tank 5*t* and/or feeding device 5*h* of an electrolyte solution mixing device 5. In some embodiments, the guide or boom can be moved to help adjust or drive adjustment of the horizontal position of the elongated member 3*f* and the vessel holding device 3*e*. In other arrangements, the upper rail 3*c* or other element can be stationary or in a fixed position and a guide or trolley can be moved along that structure of the upper rail 3*c* to provide horizontal positional adjustment of the elongated member 3*f* and the vessel holding device 3*f*.

The retraction of the elongated member 3*f* can drive adjustment of the vertical position of the vessel holding device 3*e* to lift that vessel holding device 3*e* (and any vessel retained or grasped therein) to a higher vertical position. The extension of the elongated member 3*f* can drive vertical lowering of the vessel holding device 3*e* (e.g. to lower the vessel 3*a* retained by the vessel holding device 3*e* into a feed device 5*h* or closer to a tank 5*t*, etc.). The extension and retraction of the elongated member 3*f* can be facilitated by driven motion of at least one spool about which the elongated member can be wound on during retraction and unwound from during extension.

An exemplary feeding process for feeding electrolyte material to the electrolyte solution mixing device 5 can also be appreciated from FIG. 2. In a first step 4*a*, one or more vessels 3*a* retaining electrolyte material (e.g. flakes of electrolyte material, solid particulates of electrolyte material, extrudates of electrolyte material, a highly concentrated electrolyte solution having a high concentration of at least one electrolyte, etc.) can be positioned near the lifting mechanism 3*c* or in a storage area near the lifting mechanism 3*c*. In a second step 4*b*, the vessel holding device 3*e* can be positioned to retain or hold a vessel 3*a* and subsequently lift the vessel 3*a* (as indicated by the LIFT arrow in FIG. 2) to adjust a vertical position of the vessel. In a third step 4*c*, at least the horizontal position of the vessel 3*a* and vessel holding device 3*e* retaining the vessel 3*a* can be adjusted (as indicated by the FEED arrow in FIG. 2) to position the vessel 3*a* retained by the vessel holding device 3*e* into, over, or to a feed device 5*h* of the electrolyte solution mixing device 5. This can also position the vessel 3*a* over the tank 5*t* of the electrolyte solution mixing device 5. The horizontal motion of the vessel holding device 3*e* can be a result of motion of a guide or pulley about which the elongated member 3*f* is engaged or via motion of a spool about which the elongated member 3*f* is windable onto for retraction and unwindable from for extension. This horizontal motion can be a result of a guide, pulley or spool moving along upper rail 3*c* or via motion of a boom or other horizontal positioning mechanism of the lifting mechanism 3*d*. It should also be appreciated that the vertical adjustment in position of the vessel 3*a* can be, at least in part, due to the retraction or extension of the elongated member 3*f*. Vertical positional adjustment can also occur via motion of the guide, trolley, or boom to which the elongated member 3*f* and vessel holding device 3*e* can be connected.

Once the vessel 3*a* is in a desired position for feeding the electrolyte material stored in the vessel 3*a* to the tank 5*t* or feed device 5*h* of the electrolyte solution mixing device 5, the vessel 3*a* can be actuated to empty the vessel so the electrolyte material retained therein can be fed to the feed device 5*h* or tank 5*t*. The emptying of the vessel can be provided by ripping a bag, for example, to open the bag. The emptying of the vessel can also be provided by actuating a valve 3*v* of the vessel 3*a* to open the valve for emptying the vessel 3*a*. The valve 3*v* can be, for example, a slide gate, an isolation valve, or an iris type valve in some configurations.

The valve 3*v* can be positioned in the feed device 5*h* or over the feed device 5*h* for actuation of the valve to open the valve to feed the electrolyte material from within the vessel 3*a* into a hopper of the feed device 5*h* for example. As indicated by broken line arrow 4*d* in FIG. 2, the electrolyte material can be fed into the feed device 5*h* or tank 5*t* via gravity due to the positioning of the vessel and actuation of the valve 3*v* or opening of the vessel 3*a* (e.g. ripping open the bag if the vessel is a bag, actuation of another opening mechanism for the vessel, etc.). In some configurations, the position of the lifting mechanism 3*d* can also be adjusted to help shake or move the vessel vertically to help facilitate emptying of the vessel and feeding of the electrolyte material stored in the vessel 3*a* to the feed device 5*h* or tank 5*t* of the electrolyte solution mixing device 5.

For instance, in some embodiments the vessel 3*a* can be configured as a super sack that can include a liner and an extendable spout at its bottom. An operator can extend the spout into the feed device 5*h* and cut the liner to allow for discharge from the vessel 3*a* after the vessel 3*a* is lifted to a desired position for feeding the feed device 5*h*. The feed device 5*h* can be configured to have a feed box or contaminant conduit so particulate dust can be captured via a filtering device 5*f* connected to the feed device 5*h*. The filtering device 5*f* can be configured to capture fines from the particulate material so that corrosive fines, or dust, that can be bad for the health of personnel can be captured to avoid exposing that material to personnel. A filtering device 5*f* connected to the feed device 5*f* can include a dust filter connection with the feed device hopper to allow the fines of the solid particulate material (or dust) to be re-introduced by gravity without worker contact.

The feed device 5*h* can also include one or more flow initiation devices. Examples of flow initiation device(s) can include paddle(s), vibrator(s), agitator(s) and/or combinations thereof. The flow initiation device(s) can be configured and positioned to facilitate feeding of material into the tank 5*t*. The flow initiation device(s) can also be positioned and configured so that they can be actuated to facilitate unloading of the vessel 3*a*.

Once the feed device 5*h* is sufficiently fed with electrolyte material from one or more vessels or the tank 5*t* is sufficiently fed with electrolyte material from one or more vessels, the lifting mechanism 3*d* can be positioned to a desired location to avoid interfering with other operations of the electrolyte solution mixing device 5. It should be appreciated that the feeding of electrolyte material to the feed device 5*h* via operation of the lifting mechanism 3*d* can occur prior to initiation of mixing of electrolyte solution and/or can occur while electrolyte material is being mixed in the tank with a solvent (e.g. water, demineralized water, etc.) or fed into the tank 5*t* for formation of electrolyte solution.

Figure 3:
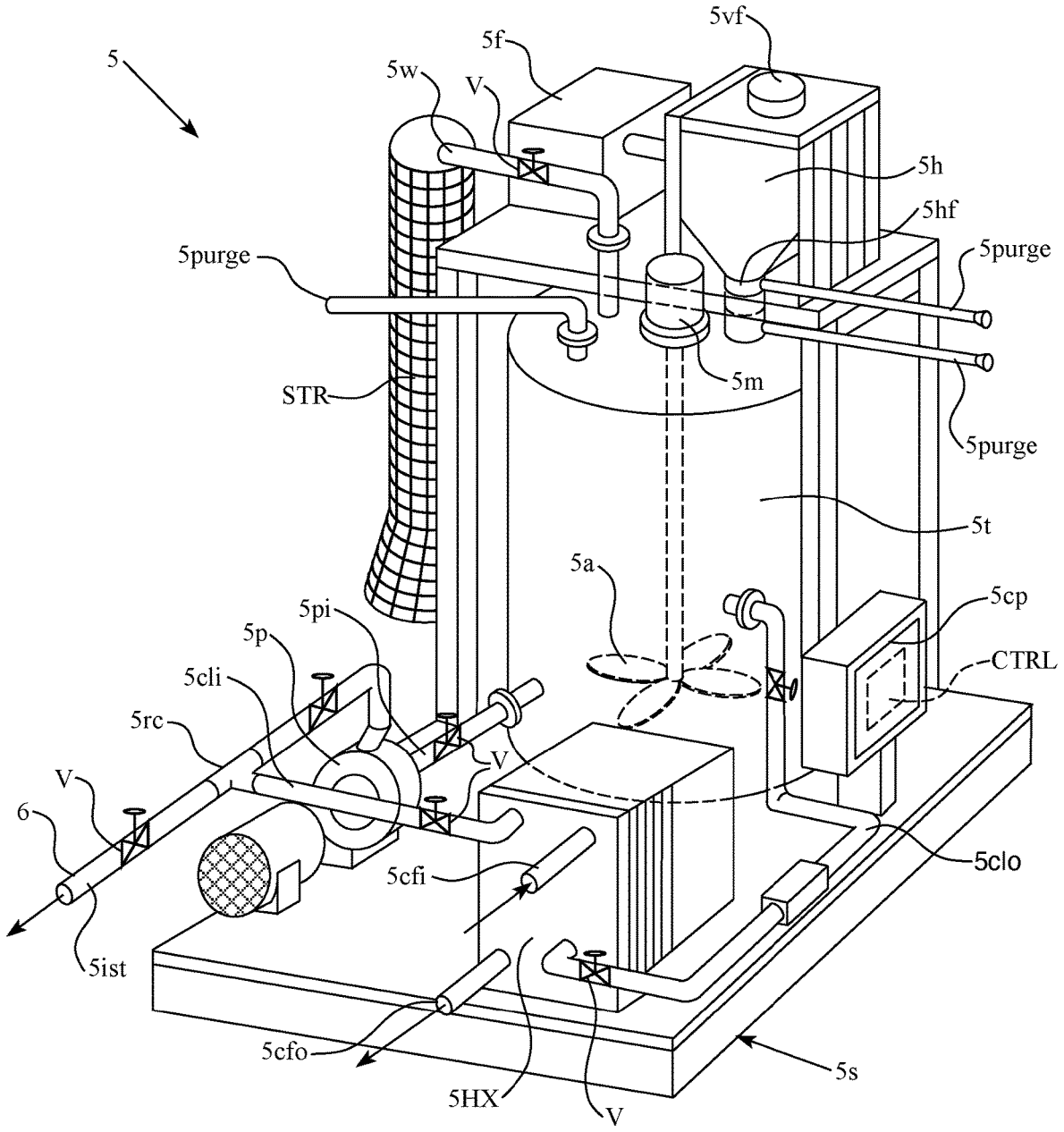
FIG. 3 is a schematic view of a first exemplary embodiment of an electrolyte solution mixing device 5 that can be included in the first exemplary embodiment of the electrolyte solution production system 2 and/or the first exemplary embodiment of the plant 1 shown in FIG. 1.

FIG. 3 illustrates an exemplary embodiment of the electrolyte solution mixing device 5 of the electrolyte solution production system 2 (a partial view of which can be appreciated from FIG. 2). The electrolyte solution mixing device 5 can include a tank 5*t* that is supported on a base 5*s*. The base 5*s* can support the tank 5*t* and other components of the electrolyte solution mixing device 5 so the base 5*s* is between those components and the ground or those components and a floor. For instance, the base 5*s* can be a skid or other support structure that is sized to support the tank 5*t* and other components of the electrolyte solution mixing device 5. The base 5*s* can be sized and configured to facilitate the moving of the base for lifting the base onto a transport vehicle 11 (e.g. flatbed of a truck, container, etc.) and lowering the base off of the transport vehicle 11. The base 5*s* can also (or alternatively) be structured as a trailer or other moveable support that can include stands or adjustable supports that can be positioned to help support the trailer in a stationary position when the electrolyte solution mixing device 5 is used to make electrolyte solution while also permitting removal of the stands or adjustment of the supports to permit the base 5*s* to be towed to a new location by a transport vehicle 11.

The tank 5*t* can include a bottom, at least one sidewall and a top that can define a mixing chamber within the tank St. The tank can have a pre-selected volume or geometry (e.g. be cylindrical in shape or cubical in shape, etc.). In some configurations, the mixing chamber can be open (e.g. there may not be a top or the top may only partially enclose the mixing chamber). In other configurations, the top of the tank can fully cover the mixing chamber to fully enclose the mixing chamber within the tank sidewall(s) and tank bottom.

A feed device 5*h* can be connected to the tank 5*t* or positioned over the tank 5*t* to facilitate feeding of electrolyte material into the tank St. The feed device 5*h* can include a hopper configured to retain electrolyte material received from one or more vessels 3*a* via the material handling device 3. A tank feed valve 5*hf* of the feed device 5*h* can be positioned in or at a lower portion of the feed device 5*f* (e.g. at a bottom of the feed device 5*h*). The tank feed valve 5*hf* can be adjusted between a closed position and an open position. In the open position, electrolyte material stored in a cavity of the feed device can be fed from the feed device 5*h* into the mixing chamber of the tank 5*t* via a feed conduit of the feed device 5*h* that is in fluid communication with the feed valve 5*hf*. In the closed position, the tank feed valve 5*hf* can help retain the electrolyte material within the feed cavity of the feed device 5*h*. In some configurations, the tank feed valve 5*hf* can be a rotary valve or other type of adjustable feed valve connected to a feed conduit positioned between the tank 5*t* and the feed device 5*h*.

For example, the feed valve 5*hf* can be rotary valve. The feed valve 5*hf* can include a rotary valve that is a multi-vane device with pockets that rotate, for example. The feed valve 5*hf* can be operated under speed control or in a loss-in-weight function in some implementations. Solids can fall in pockets and can be transported as the valve body rotates. The rate of rotation of the body of the valve can affect the feed rate at which the solid material is transferred to the tank 5*t*.

In a speed control mode, the rate of speed can be set by an operator and can be adjusted manually or automatically to achieve a desired concentration of solution. In loss-in-weight operation, the feed device hopper can be positioned on load cells. The rate of addition (weight loss per time) can be set and the speed of the feed valve 5*hf* can be varied to maintain the pre-defined, or pre-selected, rate of addition of feed.

The feed device 5*h* can also be connected to a filtering device 5*f* as discussed above. The filtering device 5*f* can be a bag filter or other type of filtering device that can be configured to collect fines of the electrolyte material for storage therein. The fines can then be emptied from the filter for subsequent disposal or recycling of the material for subsequent use. Alternatively (or in addition), the fines can be collected via the filtering device 5*f* while the feed device 5*h* receives the electrolyte material (e.g. solid electrolyte particulate material) to avoid electrolyte particulate material being inhaled by personnel near the feed device 5*h* and providing improved safety related to the feeding the electrolyte material into the feed device 5*h*. For instance, the filtering device 5*f* can be arranged and configured to minimize or eliminate physical exposure personnel may have to fines of the electrolyte material to help improve the safety of that personnel. The filtering device 5*f* can also be connected to the feed device 5*h* so that dust or fines collected by the filtering device 5*f* can be returned to the feed device 5*h* (e.g. via gravity) for subsequent feeding to the tank 5*t* (e.g. as discussed above).

The feed device 5*h* can also include a vessel feed valve 5*vf*. The vessel feed valve 5*vf* can be structured as an iris valve or other type of suitable valve that can be adjusted between a closed position and an open position. The vessel feed valve 5*vf* can be opened to facilitate vessel opening of a vessel 3*a* that contains electrolyte material so electrolyte material from within the vessel 3*a* can be passed into a hopper or electrolyte material storage cavity of the feed device 5*h*. In some embodiments, the vessel feed valve 5*vf* can also be configured to be adjusted or controlled to actuate opening of the vessel 3*a* to facilitate the opening and emptying of the electrolyte material within the vessel 3*a* so the material is fed into the feed device 5*h*.

The tank 5*t* can have at least one agitator 5*a* positioned therein. The agitator 5*a* can include a shaft having one or more blades connected to the shaft. An end of the shaft can be coupled to an agitator motor 5*m* that can be actuated to rotate the shaft to spin at least one blade of the agitator 5*a* within the tank 5*t*. The blade(s) of the agitator 5*a* can be positioned within the mixing chamber of the tank 5*t* for spinning therein to facilitate mixing or convection, for example. The mixing or convection that can be provided by spinning one or more blades of the agitator 5*a* via rotation of the shaft that can be driven by the motor 5*m* can help disperse the electrolyte material within the liquid solvent (e.g. demineralized water, water, etc.) fed to the tank for forming the electrolyte solution. The agitation powered by the agitation motor 5*m* can provide a rotation of the one or more blades at a pre-selected rotational speed for a pre-selected rotational time period. The pre-selected rotational speed can be any suitable speed. For example, the pre-selected rotational speed can be a rotational speed of between 1 revolutions per minute (RPM) to 250 RPM or a speed that is greater than 1 RPM and less than or equal to 300 RPM (e.g. 20-40 RPM, 30 RPM, 15-45 RPM, etc.). The pre-selected rotational time period can range from (a) greater than 1 second to 6 hours, (b) greater than 30 second to 4 hours, (c) between 30 minutes and 2 hours, (d) between 1 hour and 10 hours, or (e) another suitable time range.

The motor 5*m* can be connected to a top of the tank 5*t* in some embodiments. The motor 5*m* can be positioned adjacent to the feed device 5*h* or a hopper of the feed device 5*h*, which can also be positioned on or adjacent a top of the tank 5*t*. The filtering device 5*f* can also be positioned adjacent the top of the tank 5*t*. A stairway STR can be provided adjacent the tank 5*t* so an operator can climb to the top of the tank to look into the tank (if the top of the tank is open or at least partially open) or manually check on devices positioned on or adjacent the top of the tank when the top of the tank is enclosed by a ceiling or upper tank structure (e.g. a tank roof or sidewall enclosing the top of the tank 5*t* and the mixing chamber within the tank).

A solvent feed conduit 5*w* can also be connected to the tank 5*t* to feed a solvent therein. The solvent to be fed into the tank can be water or can comprise water (e.g. be demineralized water, be deionized water, be potable water, etc.). The solvent feed conduit 5*w* can include one or more valves V that can be adjusted between open and closed position to adjust the feeding of the solvent into the tank. At least one valve V can be opened for feeding solvent into the tank. A feed valve V of the solvent feed conduit 5*w* can be closed to stop feeding water into the tank for a semi-batch or batch operation of the electrolyte solvent mixing device 5. The feed valve V of the solvent feed conduit can be opened for feeding the solvent into the tank for being mixed therein with the electrolyte material that can be provided via the feed device 5*h* and/or vessel(s) 3*a*.

The tank 5*t* and/or feed device 5*h* can also be connected to a purge conduit Spurge. The purge conduit can be connected to the tank to facilitate purging of the tank or feeding a purge gas to the mixing chamber of the tank St. The purging of the tank can include nitrogen purging or off-gassing of the tank. The purging can be performed to help clean the tank 5*t*, dry the mixing chamber of the tank 5*t*, and/or help pressurize the tank to a desired pressure within a pre-selected pressure range. A tank inlet of the purge conduit Spurge can be positioned at or adjacent a top of the tank St.

The feed device 5*h* can be connected to at least one purge conduit 5 purge as well or as an alternative. The purge conduit 5 purge can be arranged so that a purge gas (e.g. nitrogen gas, other suitable purge gas) is feedable to the feed device 5*h* to remove fines or powder of electrolyte material to clean the feed device, prevent solid electrolyte material stored in the feed device 5*h* from absorbing moisture, or sludging.

The purge gas fed to the tank 5*t* and/or the feed device 5*h* can be output from the tank or feed device for venting via a purge vent conduit connected to the feed device 5*h* or the tank 5*t*. Venting can be implemented to permit cleaning of the feed device 5*h* to occur to remove fine particulates from the feed device 5*h*, for example.

The electrolyte solution mixing device 5 can also include a heat exchanger 5HX and a recirculation pump 5*p* that can be supported on the base 5*s* and be communicatively connected to the mixing chamber of the tank 5*t*. For instance, the pump 5*p* can be connected between the tank 5*t*, the heat exchanger 5HX as well as the intermediate storage and transport system 7 via a conduit arrangement 6. The conduit arrangement 6 can include valves V that are adjustable between open and closed positions to facilitate the circulation of fluid from within the tank to the heat exchanger 5HX and back into the tank 5*t* for heating the contents within the mixing chamber of the tank 5*t* or retaining the material within the mixing chamber of the tank at a desired temperature or within a pre-selected temperature range. After the electrolyte solution is formed in the tank 5*t* and has a pre-selected concentration of the electrolyte within the solution, the valves V of the conduit arrangement 6 can be adjusted between opened and closed positions to facilitate emptying of the mixing chamber of the tank 5*t* and feeding of a formed electrolyte solution within the mixing chamber out of the tank 5*t* and to the intermediate storage and transport system 7. Such adjustment of the valves V of the conduit arrangement 6 can occur so that fluid from the tank 5*t* is prevented from passing into and out of the heat exchanger 5HX while the tank is emptied (or at least partially emptied) and the electrolyte solution is fed out of the tank 5*t* and to the intermediate storage and transport system 7.

For example, the conduit arrangement 6 can include a heat exchanger output conduit 5*clo* that is positioned between the tank 5*t* and the heat exchanger 5HX, and a heat exchanger inlet conduit 5*cli* that is positioned between the pump 5*p* and the heat exchanger 5HX. The conduit arrangement 6 can also include a pump feed conduit 5*pi* connected between the pump 5*p* and the tank 5*t*, and a pump output conduit 5*rc* connected between the pump 5*p*, the heat exchanger inlet conduit 5*cli*, and an intermediate storage and transport feed conduit 5*ist* that is positioned between the pump 5*p* and an electrolyte solution feed conduit for feeding the electrolyte solution from the tank 5*t* to the intermediate storage and transport system 7. A valve V of the heat exchanger inlet conduit 5*cli* can be closed and a valve V of the pump output conduit 5*rc* can be opened for feeding fluid from the tank 5*t* to the intermediate storage and transport system 7 via the intermediate storage and transport feed conduit 5*ist*. A valve of the pump output conduit 5*rc* can be closed and the valve of the heat exchanger inlet conduit 5*cli* can be opened for feeding fluid from the tank 5*t* to the heat exchanger 5HX for being cooled therein prior to feeding that fluid back into the tank 5*t* via the heat exchanger output conduit 5*clo*.

The heat exchanger 5HX can also be connected to a heat exchanger medium inlet conduit 5*cfi* and a heat exchanger medium output conduit 5*cfo*. These conduits can be connectable to a source of a cooling fluid (e.g. cooling water) that can be passed into the heat exchanger 5HX to cool the heated fluid from the tank 5*t* that is passed into the heat exchanger 5HX so that the tank fluid output from the heat exchanger 5HX for being fed back to the tank 5*t* via the heat exchanger output conduit 5*clo* is cooled. The warmed heat exchange fluid can be output from the heat exchanger 5HX via the heat exchanger medium output conduit 5*cfo*. The cooling fluid can be another type of fluid instead of cooling water (e.g. a flow of cooled gas, a flow of fluid having a pre-selected cooling temperature, a flow of refrigerant, etc.).

The heat exchanger 5HX can be configured to provide cooling to the tank 5*t* in other arrangements. For instance, in some embodiments, the heat exchanger 5HX can include a cooling coil conduit that passes through the tank 5*t*. A cooling fluid can be passed into the tank to provide cooling therein via a cooling fluid coil inlet portion, a heat exchange coil conduit within the tank can be positioned in the tank so that the cooling fluid in that portion receives heat from the fluid within the tank 5*t* to cool that fluid and warm the cooling fluid within the cooling fluid coil. The warmed cooling fluid can be output from the tank via the cooling fluid coil outlet. In such embodiments, the conduit arrangement may not include the heat exchanger inlet conduit 5*cli* or the heat exchanger output conduit 5*clo* since the cooling fluid may flow directly into and out of the tank via a separate cooling coil arrangement. A separate pump (not shown) may be provided to help drive the flow of cooling fluid via such an arrangement as well.

The heat exchanger 5HX can be operated to maintain the tank 5*t* or the contents of the tank 5*t* at a temperature that is within a pre-selected temperature range. For example, the diffusion or dispersion of electrolyte material from the feed device 5*h* into a solvent fed into the mixing chamber of the tank 5*t* can create heat. The heat exchanger 5HX can be configured to provide cooling to maintain the temperature of the electrolyte solution mixture fed into the tank to within a pre-selected temperature range to account for the heat provided by the exothermic reaction of the electrolyte material dissolving into the solvent (e.g. diffusing into the solvent, dispersing into the solvent, etc.). This exothermic reaction can be accelerated via the agitation that can be provided by the spinning of the agitator 5*a* as discussed above, which can help speed up the dissolution of the electrolyte material into the solvent within the mixing chamber via convection caused by the motion of the agitator 5*a*.

The heat exchanger 5HX can be positioned and configured to provide cooling to the tank 5*t* to prevent overheating of the tank or an undesired overheating of the contents of the tank while the electrolyte material is being dissolved into the solvent (e.g. water, demineralized water, etc.) to a pre-selected electrolyte concentration within a pre-selected electrolyte concentration range for the electrolyte solution that is to be fed to the intermediate storage and transport system 7 for feeding to the one or more electrolyzers 9. The pre-selected electrolyte concentration for the electrolyte solution can be an electrolyte concentration within the concentration range of (a) between 0.5 weight percent ("wt %") and 50 wt %, (b) between 1 wt % and 50 wt %, (c) between 1 wt % and 30 wt %, (d) between 1 wt % and 40 wt % or (e) another suitable range. The electrolyte can be a suitable electrolyte. For instance, the electrolyte of the electrolyte material can be potassium hydroxide (KOH), sodium hydroxide (NaOH), sodium chloride (NaCl) or potassium chloride (KCl). The electrolyte concentration for the electrolyte solution for some embodiments can be the concentration of one or more of these electrolytes within the electrolyte solution that is formed.

Once the electrolyte solution is formed via operation of the agitator 5*a*, pump 5*p*, heat exchanger 5HX, feed device 5*h*, and tank 5*t*, the pump 5*p* and conduit arrangement 6 can be adjusted to feed the electrolyte solution out of the tank 5*t* and to the intermediate storage and transport system 7 via the intermediate storage and transport feed conduit 5*ist*. This adjustment can be provided via the adjustment of valves V of the conduit arrangement 6 as discussed above, for example.

The electrolyte solution mixing device 5 can also include a control panel 5*cp* that can be supported on the base 5*s*. The control panel 5*cp* can include a housing in which at least one controller CTRL is positioned. The controller CTRL can be communicatively connected to sensors positioned in or on the tank 5*t*, feed device 5*h*, pump 5*p*, heat exchanger 5HX, and/or conduit arrangement 6. The sensors can include one or more temperature sensors, one or more pressure sensors, one or more density sensors, one or more flow rate sensors, one or more concentration sensors, one or more level detectors, one or more level controllers, and/or one or more pH sensors. The controller CTRL can also be communicatively connected to the valves V and motor 5*m* to control adjustment of valve positions or motor operation for controlling when the agitator may rotate and what speed the agitator may rotate at. The controller CTRL can also be connected to valves of the feed device to control how much of the electrolyte material may be fed into the tank and/or the flow rate at which the electrolyte material may be fed into the tank 5*t*.

Figure 4:
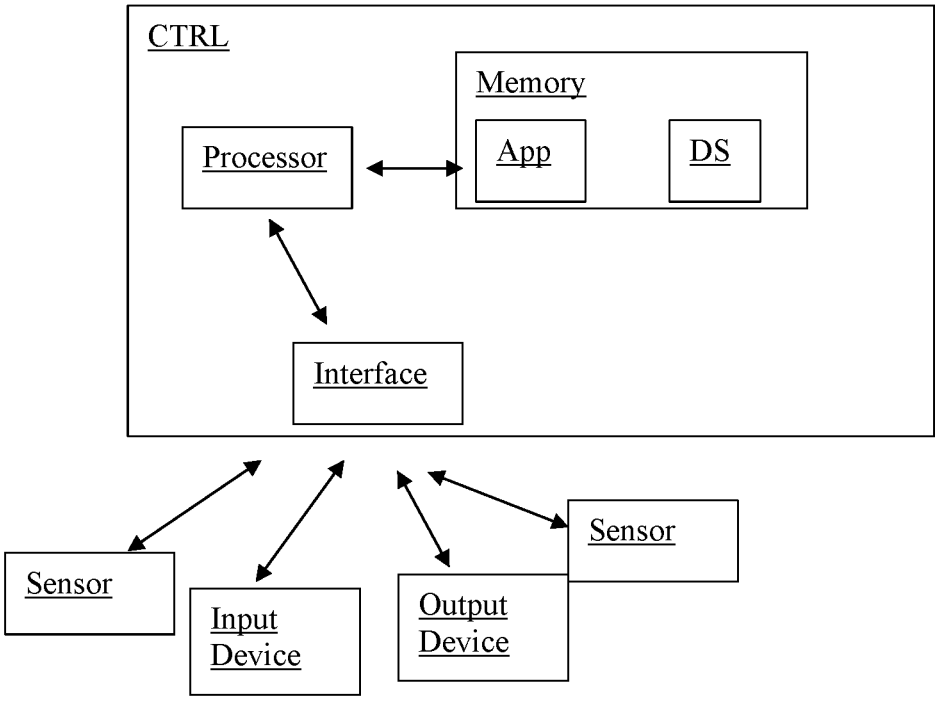
FIG. 4 is a block diagram of an exemplary embodiment of a controller CTRL that can be included in the first exemplary embodiment of the electrolyte solution mixing device 5 shown in FIG. 3, the first exemplary embodiment of the electrolyte solution production system 2 shown in FIG. 1, and/or the first exemplary embodiment of the plant 1 shown in FIG. 1.

An example of such a controller CTRL can be appreciated from FIG. 4. The controller can include hardware. The hardware can include a processor connected to non-transitory memory that can store code thereon. The code can define at least one application (App). The memory can also store at least one data store (DS). The data store can include at least one file, at least one database, or other element that may be utilized when the application is run by the processor. The application's code or other code can define a method that is monitored or caused to be executed by the controller CTRL when the processor runs the code.

The controller CTRL can also include at least one interface to facilitate communicative connections with the sensors. The interface can also provide a communicative connection with at least one input device and/or at least one output device. For instance, a user device, keyboard, button, or pointer device can be input devices that can be communicatively connected to the controller CTRL. The output device connectable to the controller can include one or more of a printer, a user device display, a display or a speaker, or other type of output device. A user device (e.g. a tablet, personal computer, laptop computer, smart phone, etc.) can be configured to communicatively connect to the controller CTRL to provide input to adjust setpoints, alarm limits, or other parameters and also receive output from the controller such as alarms or warnings. In some embodiments, the controller CTRL can be included in an automated process control system of the plant 1 or the electrolyte production system 2 or can be part of a distributed control system (DCS) of the plant 1 or the electrolyte production system 2.

Embodiments of the plant 1 and the electrolyte solution production system 2 can be utilized in processes for electrolyte solution production. Such processes can be utilized in a plant 1 configured for green hydrogen production or other type of chemical manufacturing facility in which an electrolyzer 9 may be utilized. The plant 1 that may utilize such a process can also be another type of facility that may utilize one or more electrolyzers 9 as well (e.g. ammonia manufacturing, etc.). Also, embodiments of a process for electrolyte production can include an embodiment of the process for feeding electrolyte material to the electrolyte solution mixing device 5 discussed above.

Figure 5:
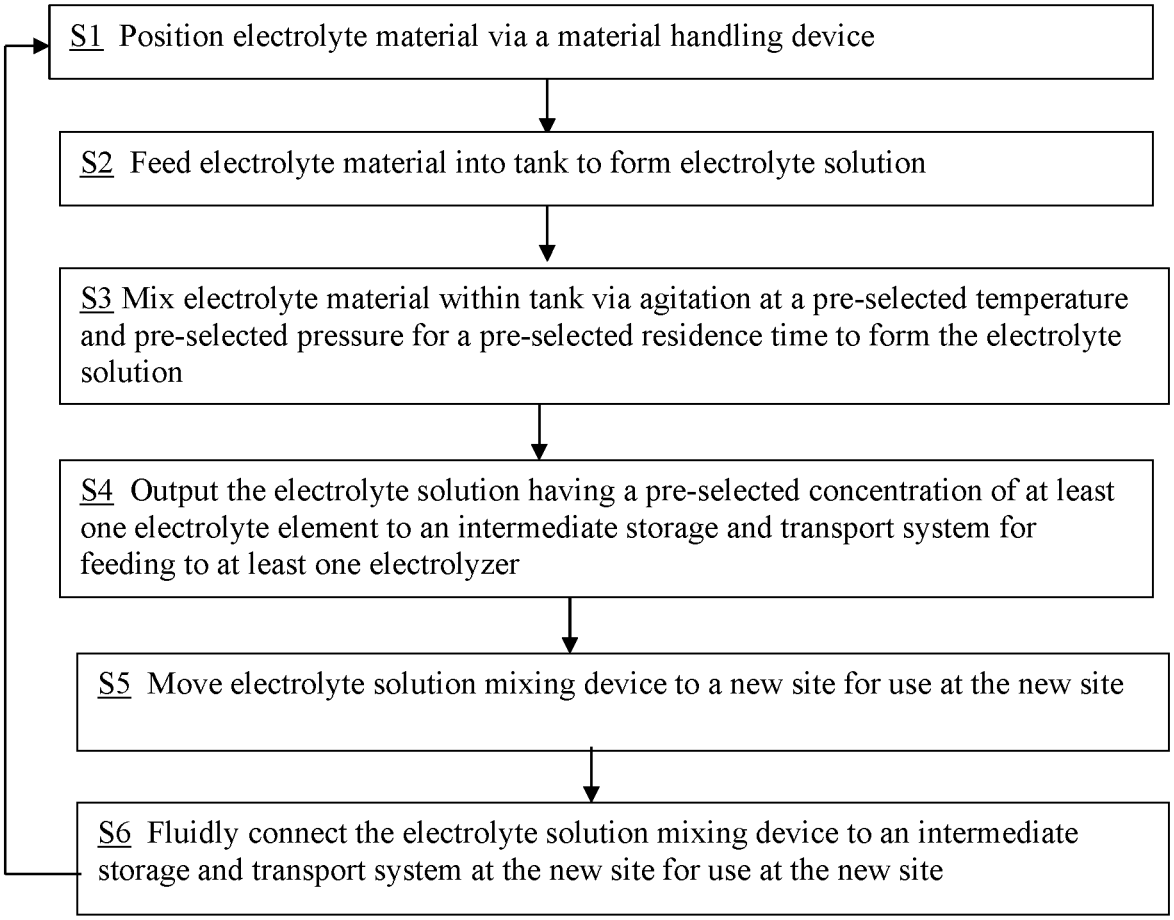
FIG. 5 is a flow chart illustrating a first exemplary embodiment of a process for electrolyte solution production.

For instance, as may be appreciated from exemplary embodiment of a process shown in FIG. 5, a first step S1 of the process can include positioning electrolyte material via a material handling device for feeding the material to a feed device 5*h* or tank 5*t* of the electrolyte solution mixing device 5. An example of this first step S1 can be appreciated from the above discussion of the exemplary process for feeding electrolyte material to the electrolyte solution mixing device 5 discussed above, for example. In some implementations, the first step S1 can include starting a filtering device 5*f* for the feed device 5*h* and positioning a vessel 3*a* above the feed device or in the feed device. A spout can be adjusted at a lower portion of the vessel and the vessel can then be cut to open the vessel 3*a*. Feed hopper access of the feed device 5*h* can subsequently be closed. In other implementations, the adjustment of the vessel to open the vessel may utilize other options (e.g. cutting a bag open, opening a valve at a lower portion of the vessel for feeding material into the feed device 5*h*, etc.).

In a second step S2, the process for electrolyte solution production can include feeding the electrolyte material into the tank to form electrolyte solution. The above noted feeding can be appreciated from the exemplary process shown in FIG. 2 as well as the above discussion concerning operation of the feeding device 5*h* and feeding of electrolyte material to the tank 5*t* discussed above, for example. In some implementations, the second step S2 can include opening a vessel feed valve 5*vf* (e.g. manually or automatically) and subsequently setting a speed or rate of weight addition of for the tank feed valve 5*hf* via control panel 5*cp* to control feeding of electrolyte material into the tank.

In a third step S3, the electrolyte material can be mixed within the tank (e.g. mixed into a solvent comprising water or demineralized water, mixed into water, etc.). The mixing can be performed or facilitated via agitation that can be provided via a rotating agitator 5*a*, as discussed above for example. The mixing can be provided at a pre-selected temperature and pre-selected pressure that are within pre-selected temperature and pressure ranges. Operation of a heat exchanger 5HX as discussed above can be provided to help provide such temperature control for example. Pressure control can be provided via feeding and/or purging of a purge gas into the tank 5*t* or out of the tank 5*t* in some embodiments as well. For instance, nitrogen gas can be fed to the tank via a purge conduit 5 purge to provide a nitrogen blanket (e.g. layer of nitrogen gas or a fluid at top portion of tank 5*t*) to help prevent atmospheric contamination from affecting the electrolyte solution being formed in the tank 5*t*. The use of such a gaseous layer, or blanket, can prevent air or carbon dioxide from being absorbed into the electrolyte solution being formed in the tank 5*t*, for example.

Once the electrolyte solution is formed and has the desired pre-selected concentration of the electrolyte within the solution, the heat exchanger 5HX can be deactivated and the conduit arrangement 6 can be adjusted by closing and opening of valves to facilitate the feeding of the formed electrolyte solution out of the tank 5*t* and to the intermediate storage and transport system 7. For instance, in a fourth step S4, the electrolyte solution having the pre-selected concentration of at least one electrolyte (e.g. KOH, NaOH, NaCl, KCl, etc.) can be output from the tank 5*t* and fed to an intermediate storage and transport system 7 for feeding to one or more electrolyzers 9.

In a fifth step S5, the electrolyte solution mixing device 5 can be decoupled from the system or plant and moved via a transportation vehicle 11 to a new site. This decoupling can occur upstream of the intermediate storage and transport system 7, for example. The decoupling can occur after sufficient electrolyte solution has been prepared and fed to the intermediate storage and transport system 7, for example. The transport vehicle 11 can move the electrolyte solution mixing device 5 via flatbed truck or other type of transport vehicle. A material handling device 3 can also be transported to the new site in some embodiments via the same transport vehicle 11 or a different transport vehicle 11 as discussed above as well.

It should be appreciated that the base 5*s* of the electrolyte solution mixing device 5 can be sized and configured so that movement of the base 5*s* via a transport vehicle 11 also causes the elements supported by the base 5*s* to be simultaneously moved as well. For example, movement of the base 5*s* via the transport vehicle 11 can also simultaneously move the tank 5*t*, agitator 5*a*, stairway STR, motor 5*m*, control panel 5*cp*, solvent feed conduit 5*w*, feed device 5*h*, pump 5*p*, heat exchange 5HX, filtering device 5*f* and conduit arrangement 6, which can all be supported by the base 5*s*.

Once the electrolyte solution mixing device 5 is positioned at the new site, the electrolyte solution mixing device 5 can be fluidly connected to an intermediate storage and transport system 7 of the plant at the new site for subsequent use at the new site. In that use, the electrolyte solution mixing device 5 can be utilized to form the same type of electrolyte solution as used at the initial site or can be used to form a different type of electrolyte solution that is suitable and desired for that new site. Such use can occur be reiteration of the previously discussed steps S1 through S4. Then, the electrolyte solution mixing device 5 can again be decoupled from the plant 1 at that second site and either returned to the first site or moved to yet another site via steps S5 and S6. This process can be repeated numerous times for different uses of the electrolyte solution mixing device 5 at different sites so that the electrolyte solution mixing device 5 can be shared by multiple different sites at different geographical locations.

Embodiments of the electrolyte production system 2 and mobile electrolyte solution mixing device 5 can be configured and utilized to form electrolyte solution to support electrolyzer operation for a plant 1 at multiple plants. In some implementations, the use can be provided to add electrolyte solution into a system to increase the concentration of an electrolyte within the electrolyte solution of the electrolyzers (e.g. provided as a makeup electrolyte solution feed or electrolyte solution concentration adjustment feed). In other situations, the electrolyte solution that is produced can be provided to the intermediate storage and transport system 7 as additional feed or fresh electrolyte solution feed for the electrolyzer(s) 9 of the plant 1.

Embodiments can permit electrolyte solution to be formed on-site in a way that provides improved safety, reduced maintenance, and reduced capital cost investment in transportation infrastructure. Embodiments can also permit the cost of the electrolyte solution mixing device 5 and/or material handling device 3 to be shared among numerous different plant operators or by numerous different production sites to provide improved operational flexibility and electrolyte solution production control for the plant operators. Such improved operational flexibility and electrolyte solution production control can be provided in a way that can also reduce operational costs, improved safety, and reduced environmental impacts that can be associated with the purchase and transport of large quantities of electrolyte solution.

It should be appreciated that modifications to the embodiments explicitly shown and discussed herein can be made to meet a particular set of design objectives or a particular set of design criteria. For instance, the arrangement of valves, piping, and other conduit elements (e.g. conduit connection mechanisms, tubing, seals, etc.) for interconnecting different units of the plant for fluid communication of the flows of fluid between different units can be arranged to meet a particular plant layout design that accounts for available area of the plant, sized equipment of the plant, and other design considerations. As another example, the flow rate, pressure, and temperature of the fluid passed through the various apparatus or system elements can vary to account for different design configurations and other design criteria. As yet another example, the type of heat exchanger 5HX arrangement, pump 5*p* arrangement, and feed device 5*h* arrangement can be adjusted to meet a particular set of design criteria. Also, the size and shape of the tank 5*t*, type or size of agitator 5*a*, and type and size of agitator motor 5*m* can be adjusted to account for a particular set of design criteria. Further the type of transport vehicle 11 can be any type of vehicle that may accommodate a particular set of design criteria and sizing of the electrolyte solution production system 2.

It should also be appreciated that embodiments of a plant 1, mobile electrolyte solution production system, electrolyte solution production system 2, and embodiments of a process for electrolyte solution production, can each be configured to include or utilize process control elements positioned and configured to monitor and control operations (e.g. temperature and pressure sensors, flow sensors, level controllers, detectors, concentration sensors, an automated process control system having at least one work station that includes a processor, non-transitory memory and at least one transceiver for communications with the sensor elements, valves, and controllers for providing a user interface for an automated process control system that may be run at the work station and/or another computer device of a plant or production system, etc.).

As another example, it is contemplated that a particular feature described, either individually or as part of an embodiment, can be combined with other individually described features, or parts of other embodiments. The elements and acts of the various embodiments described herein can therefore be combined to provide further embodiments. Thus, while certain exemplary embodiments of the process, apparatus, system and methods of making and using the same have been shown and described above, it is to be distinctly understood that the invention is not limited thereto but may be otherwise variously embodied and practiced within the scope of the following claims.

What is claimed is:

1. An apparatus for electrolyte solution production, comprising:
   - a mobile electrolyte solution mixing device comprising:
     - a base sized and configured for transportation via a transport vehicle;
     - a tank supported on the base, the tank having a mixing chamber;
     - the tank configured to receive electrolyte material in the mixing chamber and a liquid solvent comprising liquid water in the mixing chamber to form an electrolyte solution therein, the electrolyte solution comprising the liquid water and the electrolyte material mixed therein; and
     - an intermediate storage and transport feed conduit fluidly connected to the tank to feed the electrolyte solution from the mixing chamber to an intermediate storage and transport system of a plant positioned to feed the electrolyte solution to at least one electrolyzer to form hydrogen via electrolysis.

2. The apparatus of claim 1, wherein the mobile electrolyte solution mixing device also comprises a feed device positioned to feed the electrolyte material into the mixing chamber.

3. The apparatus of claim 2, wherein the feed device comprises a hopper positioned over the tank.

4. The apparatus of claim 1, wherein the water is demineralized water.

5. The apparatus of claim 1, comprising:
   - a material handling device comprising a lifting mechanism to lift at least one vessel retaining the electrolyte material feed feeding the electrolyte material to the mixing chamber of the tank or a feed device connected to the tank to receive the electrolyte material from the at least one vessel for feeding the electrolyte material into the mixing chamber.

6. The apparatus of claim 5, wherein the material handling device comprises:

an elongated member that is retractable and extendable; and a vessel holding device connected to the elongated member.

7. The apparatus of claim 5, wherein the material handling device is supported on the base or is positionable adjacent to the tank.

8. The apparatus of claim 1, wherein the mobile electrolyte solution mixing device also comprises:

a solvent feed conduit connected to the tank for feeding a liquid solvent into the mixing chamber.

9. The apparatus of claim 1, wherein the mobile electrolyte solution mixing device also comprises:

a pump supported by the base, the pump connected to the tank to output the electrolyte solution out of the tank.

10. The apparatus of claim 1, wherein the mobile electrolyte solution mixing device also comprises:

a heat exchanger supported on the base, the heat exchanger connected to the tank for cooling the mixing chamber.

11. The apparatus of claim 1, wherein the mobile electrolyte solution mixing device also comprises:

an agitator positioned in the mixing chamber, the agitator having a shaft connected to a motor to drive rotation of the shaft to spin at least one blade of the agitator within the mixing chamber.

12. The apparatus of claim 1, comprising:

a material handling device comprising a lifting mechanism to lift at least one vessel retaining the electrolyte material for feeding the electrolyte material to the mixing chamber of the tank or a feed device connected to the tank to receive the electrolyte material from the at least one vessel for feeding the electrolyte material into the mixing chamber;

the intermediate storage and transport system of the plant; and the at least one electrolyzer connected to the intermediate storage and transport system so that the electrolyte solution output from the tank is feedable to the at least one electrolyzer.

13. The apparatus of claim 1, wherein the electrolyte solution comprises water and an electrolyte, the electrolyte comprising KOH, NaOH, NaCl, or KCl, the electrolyte solution having a pre-selected concentration of the electrolyte within a range of between 0.5 weight percent (wt %) and 40 wt %.

14. An apparatus for electrolyte solution production, comprising:

a electrolyte solution mixing device comprising:

a mobile base;

a tank supported on the base, the tank having a mixing chamber;

the tank configured to receive electrolyte material in the mixing chamber and a liquid solvent in the mixing chamber to form an electrolyte solution therein, the liquid solvent comprising liquid water and the electrolyte solution comprising the liquid water and the electrolyte solution comprising the liquid water and the electrolyte material mixed therein; and an intermediate storage and transport feed conduit supported on the mobile base, the intermediate storage and transport feed conduit being fluidly connected to the tank to feed the electrolyte solution from the mixing chamber to an intermediate storage and transport system of a plant positioned to feed the electrolyte solution to at least one electrolyzer to form hydrogen via electrolysis.

15. The apparatus of claim 14, wherein the electrolyte solution comprises electrolyte, the electrolyte comprising KOH, NaOH, NaCl, or KCl, the electrolyte solution having a pre-selected concentration of the electrolyte within a range of between 0.5 weight percent (wt %) and 40 wt %.

16. The apparatus of claim 15, wherein the electrolyte solution has the pre-selected concentration of the electrolyte within a range of between 1 wt % and 10 wt %.

17. The apparatus of claim 15, wherein the electrolyte solution has the pre-selected concentration of the electrolyte within a range of between 1 wt % and 30 wt %.

18. The apparatus of claim 12, wherein the electrolyte solution comprises an electrolyte, the electrolyte comprising KOH, NaOH, NaCl, or KCl, the electrolyte solution having a pre-selected concentration of the electrolyte within a range of between 0.5 weight percent (wt %) and 40 wt %.

19. The apparatus of claim 18, wherein the electrolyte solution has the pre-selected concentration of the electrolyte within a range of between 1 wt % and 10 wt %.

20. The apparatus of claim 18, wherein the electrolyte solution has the pre-selected concentration of the electrolyte within a range of between 1 wt % and 30 wt %.

* * * * *